US012146481B2

(12) United States Patent
Iijima et al.

(10) Patent No.: US 12,146,481 B2
(45) Date of Patent: Nov. 19, 2024

(54) GAS COMPRESSOR

(71) Applicant: Hitachi, Ltd., Tokyo (JP)

(72) Inventors: Ryota Iijima, Tokyo (JP); Kotaro Chiba, Tokyo (JP); Nae Hisano, Tokyo (JP)

(73) Assignee: HITACHI, LTD., Tokyo (JP)

( * ) Notice: Subject to any disclaimer, the term of this patent is extended or adjusted under 35 U.S.C. 154(b) by 67 days.

(21) Appl. No.: 18/122,831

(22) Filed: Mar. 17, 2023

(65) Prior Publication Data

US 2023/0366400 A1 Nov. 16, 2023

(30) Foreign Application Priority Data

May 13, 2022 (JP) ..... 2022-079598

(51) Int. Cl.

| | |
|---|---|
| ***F04B 39/02*** | (2006.01) |
| ***F04B 49/06*** | (2006.01) |
| ***F04B 51/00*** | (2006.01) |
| ***F04C 18/14*** | (2006.01) |
| ***F04C 28/08*** | (2006.01) |
| ***F04C 28/28*** | (2006.01) |
| ***F04C 29/02*** | (2006.01) |
| ***F04C 29/04*** | (2006.01) |

(52) U.S. Cl.

CPC ..... *F04B 39/0207* (2013.01); *F04B 49/065* (2013.01); *F04B 51/00* (2013.01); *F04C 28/08* (2013.01); *F04C 28/28* (2013.01); *F04C 29/021* (2013.01); *F04C 29/026* (2013.01); *F04C 29/04* (2013.01); *F04C 18/14* (2013.01); *F04C 2270/18* (2013.01); *F04C 2270/19* (2013.01); *F04C 2270/80* (2013.01)

(58) Field of Classification Search

CPC .... F04C 29/02; F04C 29/021; F04C 2270/19; F04C 2270/80; F04B 39/027; F04B 51/00; F16N 2200/02; F16N 2200/08

See application file for complete search history.

(56) References Cited

U.S. PATENT DOCUMENTS

2022/0099005 A1* 3/2022 Higashi ..... F01M 1/06
2023/0358248 A1* 11/2023 Yorikane ..... F04D 27/009

FOREIGN PATENT DOCUMENTS

JP 2010-127218 A 6/2010

* cited by examiner

*Primary Examiner* — Kenneth J Hansen
(74) *Attorney, Agent, or Firm* — MATTINGLY & MALUR, PC

(57) ABSTRACT

A gas compressor includes a compression mechanism, a separator tank that introduces lubricating oil to be supplied to the compression mechanism and a mixed fluid of a working fluid and lubricating oil discharged from the compression mechanism and separates the lubricating oil. An oil cooler cools the lubricating oil from the separator tank. An oil circulation path supplies cooled lubricating oil to the compression mechanism. The gas compressor includes a suction temperature sensor that detects suction temperature of the working fluid, a discharge pressure sensor that detects discharge pressure of the compressed working fluid, a rotation speed sensor that detects rotation speed of the motor. A lubricating oil state estimation unit estimates the temperature of the lubricating oil based on the detected suction temperature, discharge pressure, and rotation speed of the motor. The lubricating oil state estimation unit uses this result to estimate the deterioration state of the lubricating oil.

22 Claims, 8 Drawing Sheets

GAS COMPRESSOR

CROSS REFERENCE TO RELATED APPLICATIONS

This application claims priority to Japanese Patent Application No. JP 2022-079598 filed on May 13, 2022, the entire contents of which are incorporated by reference herein.

BACKGROUND OF THE INVENTION

1. Field of the Invention

The present invention relates to a gas compressor that compresses air and other gases, and is particularly suitable as an oil-supply-type screw compressor.

2. Description of the Related Art

Gas compressors (hereinafter, also simply referred to as a compressor) are roughly classified into oil-supply-type compressors that mix lubricating oil with gas (working fluid) during a compression stroke, and oil-free-type compressors that do not mix lubricating oil with a working fluid. In the oil-supply-type compressor, the lubricating oil seals a gap while lubricating between members forming a compression chamber, for example, between rotors or between the rotor and a casing in a case of an oil-supply-type screw compressor, and the working fluid heated by compression can be cooled by the lubricating oil having a lower temperature, and there is an advantage that compression power can be reduced.

At this time, the lubricating oil is heated by the working fluid to a high temperature, but the high temperature of the oil causes deterioration such as an increase in total acid value, and when the deterioration progresses too far, there is a possibility that clogging of a gas filter or an abnormal stop of the compressor due to an increase in viscosity of the oil is caused. Therefore, according to the related art, a replacement time is determined in accordance with physical properties of the oil so that the deterioration of the oil does not exceed an allowable value even in a case where the compressor is operated at the maximum load in a predetermined period.

Examples of means for preventing deterioration of oil due to high temperature by operation control include a technology described in JP 2010-127218 A. JP 2010-127218 A describes a compressor configured in such a way that "a motor including a compression element that compresses a refrigerant, a stator that drives the compression element, and a rotor, and lubricating oil having a kinematic viscosity at 40 degrees of 6 square millimeter/second or less are accommodated in a container, the stator includes a wiring and includes a protection device electrically connected to the wiring, efficiency of the motor is 82% or more under a high-load condition, the protection device operates by detecting a current flowing through the wiring of the stator and a temperature of the container, a temperature in the container, or a temperature near the wiring, an operation value of the protection device is a value obtained as a function of the current flowing through the wiring and the temperature of the container, the temperature in the container, or the temperature near the wiring, and the protection device operates by detecting that a temperature of the wiring has become 120 degrees or more to thereby limit an actual kinematic viscosity of the lubricating oil to 1 square millimeter/second or more under any load condition of the compressor". The described technology prevents abnormal deterioration of oil in this manner.

SUMMARY OF THE INVENTION

An actual load factor of the compressor greatly varies depending on an environment in which the compressor is used, and in a case where the load factor is relatively small, although the oil does not deteriorate much, there is no means to know the actual degree of deterioration in the individual device, and thus the oil needs to be uniformly replaced at the replacement time described above. As a result, the oil is replaced even when the remaining life of the oil is sufficient, which may cause an economic loss.

In addition, in the oil-supply-type compressor, an oil stirring loss can be reduced by reducing an oil supply amount, thereby improving the efficiency of the compressor. On the other hand, however, there is a problem that the oil is easily heated to a high temperature due to the reduction in oil amount in the compression chamber, and as a result of which, the deterioration tends to progress.

In view of this problem, if the remaining life of the oil in the individual device can be known, in a case where the remaining life is sufficient, energy saving can be achieved by reducing the oil supply amount while using the margin to a necessary extent. However, as described above, since there is no means to know the remaining life of the oil in the related art, it is not possible to operate the compressor while reducing the oil supply amount and achieving energy saving.

In JP 2010-127218 A described above, it is possible to perform control in accordance with an operation environment of the individual device in such a way that the oil temperature does not exceed a certain upper limit value to prevent the deterioration of the oil from rapidly progressing. However, in a case where the compressor is operated in a state where the oil temperature is equal to or lower than the upper limit value, it is not possible to know the remaining life itself, that is, it is not possible to know how much time is left until the deterioration of the oil exceeds the threshold.

In addition, in JP 2010-127218 A, the temperature of the oil is limited by the temperature of the wiring of the motor. Therefore, the invention described in JP 2010-127218 A cannot be applied to a compressor having a structure in which the motor and the lubricating oil are separated from each other and do not come into contact with each other.

A sensor that more directly measures the degree of deterioration of the oil exists in the market, but such a sensor is expensive, and it is difficult to mount such a sensor on the compressor because of the cost.

Therefore, if the deterioration state of the oil can be estimated using a pressure sensor or a temperature sensor normally mounted on the compressor, the remaining life of the oil circulating in the gas compressor (inside) can be known by inexpensive means, and it is possible to reduce the oil supply amount and achieve energy saving.

An object of the present invention is to obtain a gas compressor capable of knowing a remaining life of oil circulating in the compressor by inexpensive means.

In order to achieve the above object, the present invention adopts, for example, a configuration described in the claims.

The present invention includes a plurality of means for achieving the above object. An example thereof includes a gas compressor including a compression mechanism that compresses a sucked working fluid, a separator tank that introduces lubricating oil to be supplied to the compression mechanism and a mixed fluid of the working fluid and the lubricating oil discharged from the compression mechanism and separates the lubricating oil from the compressed working fluid, an oil cooler that introduces and cools the lubricating oil separated in the separator tank, an oil circulation path that supplies the lubricating oil cooled by the oil cooler to the compression mechanism, and a motor that drives the compression mechanism and is isolated from the oil circulation path, and the gas compressor includes: a suction temperature sensor that detects a suction temperature of the working fluid sucked into the compression mechanism; a discharge pressure sensor that detects a discharge pressure of the working fluid compressed by the compression mechanism; a rotation speed sensor that detects a rotation speed of the motor; and a lubricating oil state estimation unit that estimates a temperature of the lubricating oil based on the detected suction temperature, discharge pressure, and rotation speed of the motor, in which the lubricating oil state estimation unit estimates a deterioration state of the lubricating oil based on the estimated temperature of the lubricating oil.

Another characteristic of the present invention is a gas compressor including a compression mechanism that compresses a sucked working fluid, a separator tank that introduces lubricating oil to be supplied to the compression mechanism and a mixed fluid of the working fluid and the lubricating oil discharged from the compression mechanism and separates the lubricating oil from the compressed working fluid, an oil cooler that introduces and cools the lubricating oil separated in the separator tank, an oil circulation path that supplies the lubricating oil cooled by the oil cooler to the compression mechanism, and a motor that drives the compression mechanism and is isolated from the oil circulation path, and the gas compressor includes: a suction temperature sensor that detects a suction temperature of the working fluid sucked into the compression mechanism; at least one of a discharge pressure sensor that detects a discharge pressure of the working fluid compressed by the compression mechanism or a rotation speed sensor that detects a rotation speed of the motor, the discharge pressure or the rotation speed of the motor being detected by the discharge pressure sensor or rotation speed sensor; a power sensor that detects input power of the motor; and a lubricating oil state estimation unit that calculates the rotation speed or the discharge pressure that is not detected by using values of the input power detected by the power sensor and the discharge pressure or rotation speed detected by the included discharge pressure sensor or rotation speed sensor, and estimates a temperature of the lubricating oil based on the detected suction temperature, the detected discharge pressure or rotation speed of the motor, and the calculated rotation speed of the motor or discharge pressure, in which the lubricating oil state estimation unit estimates a deterioration state of the lubricating oil based on the estimated temperature of the lubricating oil.

According to the present invention, there is an effect that it is possible to obtain a gas compressor capable of knowing a remaining life of oil circulating in the compressor by inexpensive means.

DESCRIPTION OF THE PREFERRED EMBODIMENTS

Figure 1:
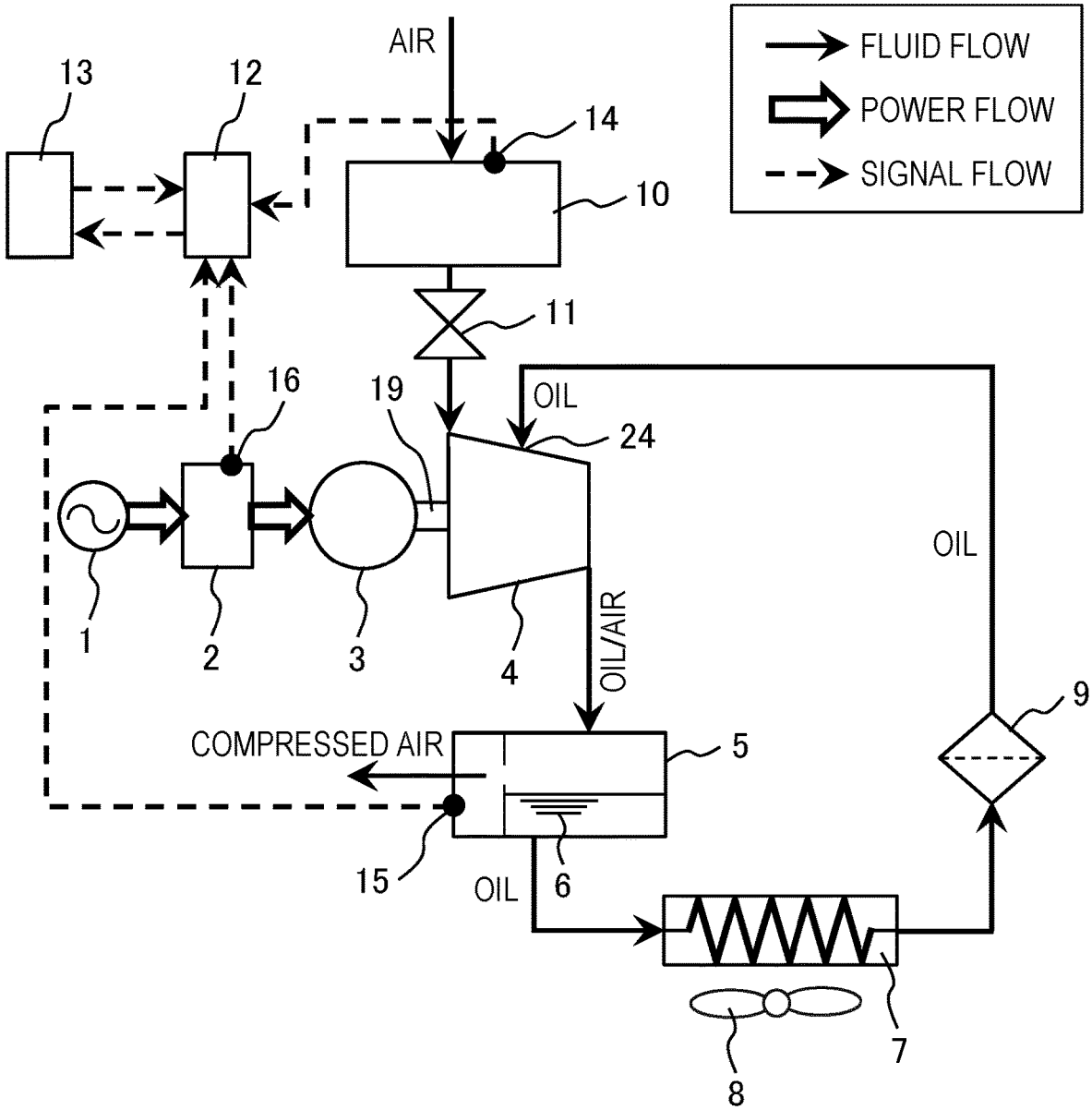
FIG. 1 is a system diagram illustrating a device configuration of a gas compressor according to a first embodiment of the present invention.

Hereinafter, specific embodiments of a gas compressor of the present invention will be described with reference to the drawings. In the drawings, the same reference numerals denote the same or corresponding parts. In each embodiment described below, a case where the compressor is an oil-supply-type screw compressor will be described. However, the scope of application of the present invention is not limited to the oil-supply-type screw compressor, and the present invention can be applied to other types of compressors.

First Embodiment

A first embodiment of the present invention will be described with reference to FIGS. 1 to 4.

Figure 2:
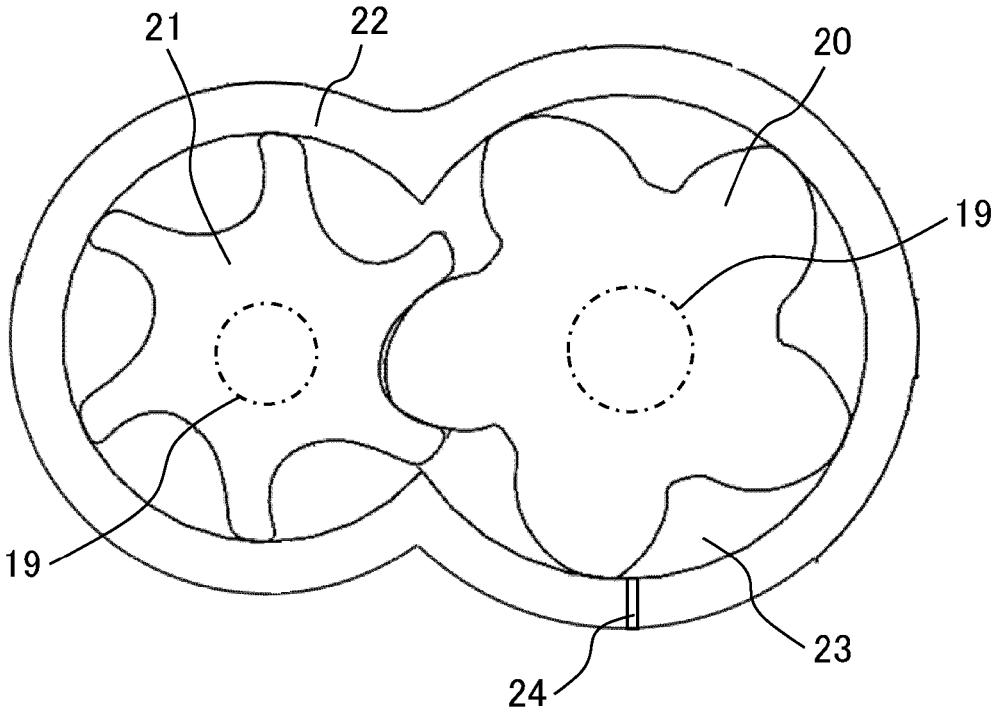
FIG. 2 is an axial vertical sectional view of a compression mechanism of the gas compressor according to the first embodiment of the present invention.

First, a configuration of an oil-supply-type screw compressor which is an example of the compressor of the present invention will be described with reference to FIGS. 1 and 2. FIG. 1 is a system diagram illustrating a device configuration of the screw compressor according to the first embodiment of the present invention, and FIG. 2 is an axial vertical sectional view of a compression mechanism of the screw compressor according to the first embodiment of the present invention. In this example, an example in which a working fluid is air will be described, but the present invention is also applicable to a compressor in which gas other than air is used as the working fluid.

In FIG. 1, Reference Numeral 1 denotes a power supply, Reference Numeral 2 denotes an inverter electrically connected to the power supply 1, Reference Numeral 3 denotes a motor electrically connected to the inverter 2, and Reference Numeral 4 denotes the compression mechanism (compressor main body) equipped with a screw rotor rotationally driven by the motor 3.

As illustrated in FIG. 2, the compression mechanism 4 includes shafts 19, a male rotor 20, a female rotor 21, a casing 22, and the like. The shaft 19 for the male rotor 20 is adjacent to and integrated with the male rotor 20 in an axial direction, and the shaft 19 for the female rotor 21 is adjacent to and integrated with the female rotor 21 in the axial direction. The shaft 19 for the male rotor 20 is mechanically coupled to the motor 3, and a rotational torque of the motor 3 can be transmitted to the shaft 19 for the male rotor 20. The motor 3 is configured to be isolated from the compression mechanism 4 so that a fluid (compressed air or lubricating oil) in the compression mechanism 4 does not flow into the motor 3.

A space surrounded by the male rotor 20, the female rotor 21, and the casing 22 is a compression chamber 23. The casing 22 has an oil supply hole 24 that intermittently communicates with the compression chamber 23.

As illustrated in FIG. 1, a separator tank 5 is provided downstream of the compression mechanism 4, a mixed fluid of compressed air and oil discharged from the compression mechanism 4 flows into the separator tank 5, oil (lubricating oil) 6 is separated from the compressed air, and the compressed air from which the oil is separated in the separator tank 5 is sent to a demand side.

A sucked air filter (hereinafter, also referred to as a suction filter) 10 and a suction throttle valve 11 are provided on a line for sucking outside air toward the compression mechanism 4. The suction filter 10 is disposed between a pipe (not illustrated) connected to outside air and the compression mechanism 4, and removes foreign matters such as dust from sucked air. The suction throttle valve 11 is disposed downstream of the suction filter 10, and the amount of sucked air is adjusted by controlling an opening degree of the suction throttle valve 11. A suction port of the compression mechanism 4 is connected downstream of the suction throttle valve 11 and is connected to the compression chamber 23.

An air flow and the like in the oil-supply-type screw compressor described above will be described. The inverter 2 controls a voltage waveform based on power supplied from the power supply 1, thereby controlling a rotation speed of the motor 3. A rotational torque of the motor 3 is transmitted to the male rotor 20 and the female rotor 21 meshing with the male rotor 20 via the shaft 19, and these two rotors rotate in opposite directions. As a result, a volume of the compression chamber 23 communicating with a suction port side increases from 0, whereby air from the outside (outside air) is taken in through the suction filter 10 and the suction throttle valve 11 and flows into the compression chamber 23.

Thereafter, as the rotors 20 and 21 further rotate, the volume of the compression chamber 23 reaches the maximum volume, and then the air is trapped in the compression chamber 23, and the volume is reduced to compress the air in the compression chamber 23 to a high temperature and high pressure state. During the compression stroke, the lubricating oil 6 having a temperature lower than that of the compressed air is supplied (injected) from the oil supply hole 24 into the compression chamber 23 to cool the air having a high temperature, and the lubricating oil itself is heated. Thereafter, the compression chamber 23 communicates with a discharge port and a discharge-side flow path at a predetermined rotor rotation angle, and the compressed air and the lubricating oil are discharged to a downstream side and flow into the separator tank 5.

The air and the lubricating oil that have flowed into the separator tank 5 are guided to form, for example, a swirling flow, so that the air and the lubricating oil are separated into the compressed air and the lubricating oil 6 by a centrifugal force. The compressed air is supplied to a pneumatic device (not illustrated) that is provided further downstream and requires the compressed air. On the other hand, the lubricating oil 6 is stored at a bottom portion of the separator tank 5.

The lubricating oil 6 separated in the separator tank 5 flows into an oil cooler 7 that is a heat exchanger provided downstream of the separator tank 5 in a path (lubricating oil circulation path) different from that of the compressed air, and is cooled to a low temperature by outside air blowing from a cooler fan 8 in the oil cooler 7. The lubricating oil having exited the oil cooler 7 passes through an oil filter 9 provided downstream of the oil cooler 7 to remove foreign matters in the lubricating oil 6, and then the lubricating oil is supplied to the compression chamber 23 again through the oil supply hole 24.

Next, a method for estimating a temperature of the compressed air or the lubricating oil and a deterioration state of the lubricating oil will be described. In order to detect the state of the compressed air and the lubricating oil, a suction temperature sensor 14 is provided in any portion upstream of the compression mechanism 4 (a portion of the sucked air filter 10 in FIG. 1) and measures the temperature of the sucked air. Information on the measured temperature of the sucked air is transferred to a control device 12 as an electric signal and further sent to a computation device 13. The computation device 13 serves as a lubricating oil state estimation unit to be described later.

The control device 12 and the computation device 13 are illustrated separately on the assumption that the computation device 13 is disposed at a remote place via the Internet or the like, but the control device 12 and the computation device 13 are not necessarily configured to be separated from each other. A position where the suction temperature sensor 14 is provided is not necessarily installed in an internal pipe or the like of the compressor, and may be replaced with a sensor that measures the ambient temperature of the compressor (for example, an outside air temperature sensor).

A discharge pressure sensor 15 that measures a pressure of the air is provided at any position downstream of the compression mechanism 4. For example, the discharge pressure sensor 15 may be provided in the separator tank 5 or may be provided in a pipe in front of or behind the separator tank 5. In a case where there is a tank for storing the compressed air downstream of the separator tank 5, the discharge pressure sensor 15 may be provided in the tank or in front of or behind the tank. Information on the pressure measured by the discharge pressure sensor 15 is transferred to the control device 12 as an electric signal and further sent to the computation device 13, similarly to the information on the temperature of the sucked air described above.

In addition, a rotation speed sensor 16 that measures the rotation speed of the motor 3 is provided, and information on the rotation speed is also sent to the computation device 13. Means for detecting the rotation speed may be a command value of the inverter 2 or a value estimated from a voltage or a current, or a motion state of the motor may be further measured by an optical or electromagnetic sensor.

The control device 12, the computation device 13, the suction temperature sensor 14, the discharge pressure sensor 15, the rotation speed sensor 16, and the like described above are normally provided in the oil-supply-type screw compressor, and it is possible to know the remaining life of the lubricating oil by inexpensive means by estimating the temperature and the degree of deterioration of the lubricating oil circulating in the compressor using these sensors and the like. In addition, knowing the remaining life of the lubricating oil makes it possible to reduce the oil supply amount and achieve energy saving.

Figure 3:
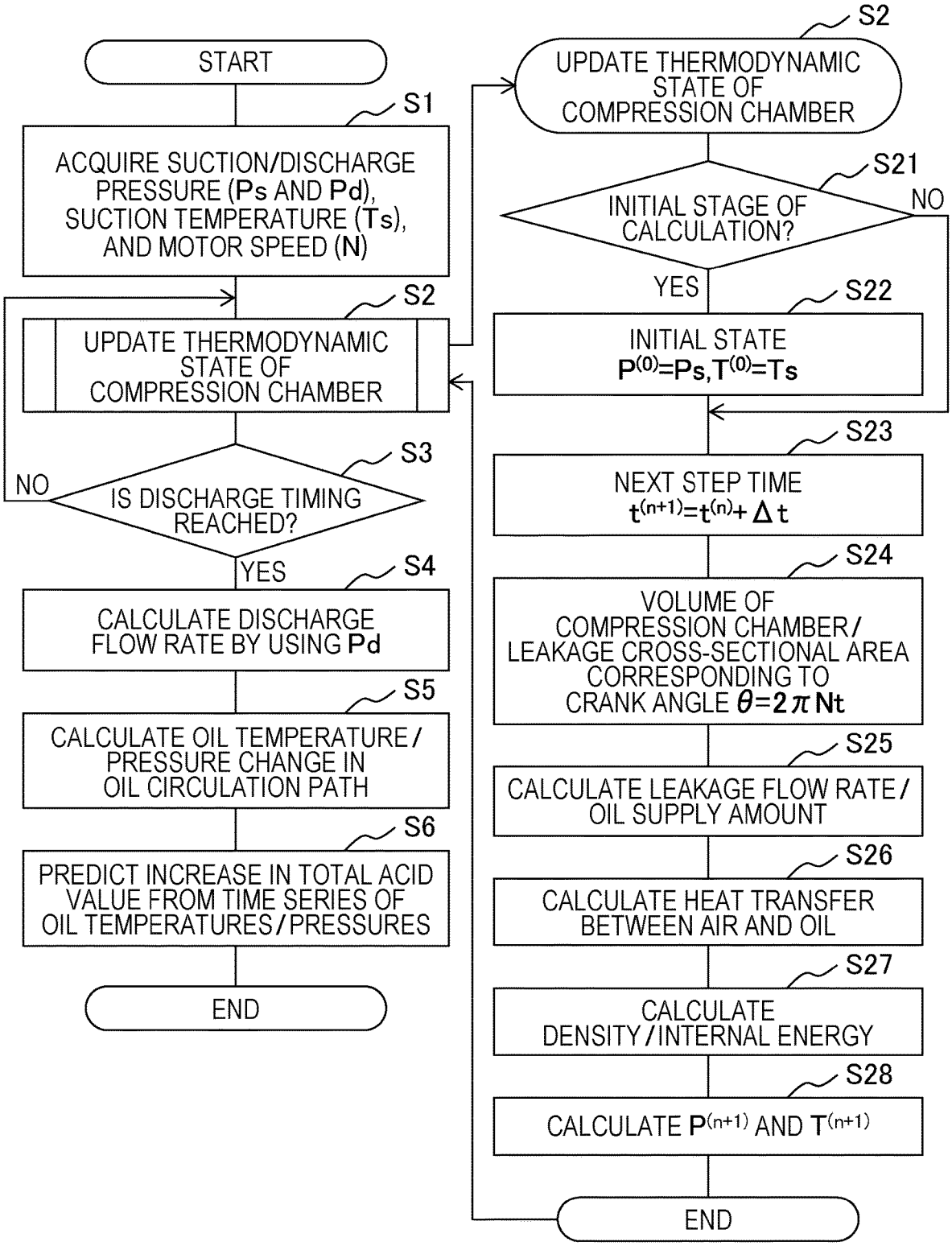
FIG. 3 is a flowchart illustrating an oil deterioration degree estimation procedure according to the first embodiment of the present invention.
Figure 4:
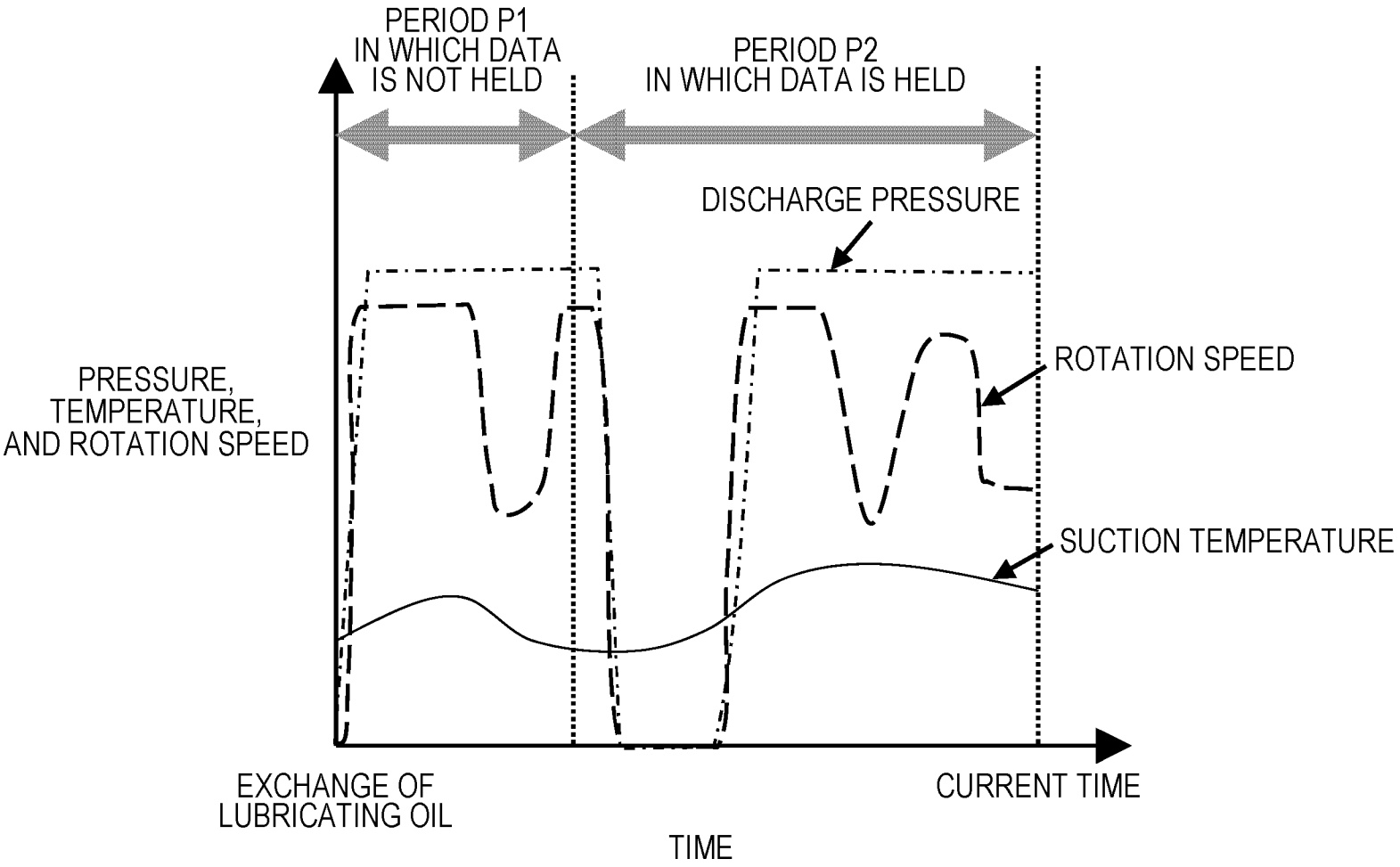
FIG. 4 is a graph illustrating an example of acquired data of an operation state according to the first embodiment of the present invention.

Next, a computation flow for estimating the temperature and the degree of deterioration of the lubricating oil from the information acquired as described above will be described with reference to FIGS. 3 and 4. FIG. 3 is a flowchart illustrating an oil deterioration degree estimation procedure according to the first embodiment of the present invention, and FIG. 4 is a graph illustrating an example of acquired data of an operation state according to the first embodiment of the present invention. Since computation of each step illustrated in FIG. 3 is executed by the computation device 13 in the present embodiment, the computation device 13 serves as the lubricating oil state estimation unit in the present embodiment.

In the flowchart of FIG. 3, the flow on the left side indicates a flow of the entire operation procedure, and the flow on the right side indicates details of a computation procedure of step S2 of "update thermodynamic state of compression chamber" which is a part of the flow on the left side. Once the computation starts, in step S1, a suction temperature Ts, a discharge pressure Pd, and a motor rotation speed N detected by the method described above are acquired. In a case where air is sucked from the outside, the suction pressure Ps is acquired assuming that the suction pressure is substantially atmospheric pressure. In a case where gas to be sucked is not air at the atmospheric pressure, the suction pressure Ps can be easily obtained by providing the suction pressure sensor upstream of the compression mechanism 4.

Next, in step S2, the thermodynamic state (pressure or temperature) of the compression chamber 23 is estimated based on these measured values. Initial values (when n=0, and Yes in step S21 of "Initial stage of calculation?" in FIG. 3) of the compression chamber 23 are given as $P^{(0)}$=Ps and $T^{(0)}$=Ts as illustrated in the flow on the right side of FIG. 3, in which $P^{(n)}$ and $T^{(n)}$ respectively represent changes in pressure and temperature of the compression chamber 23 varying in the compression stroke over time (where n is a discretized time step) (step S22). When No in "Initial stage of calculation?", the initialization operation is not performed and the processing proceeds to step S23.

When the current time step is n (time $t^{(n)}$), the thermodynamic state of the compression chamber at the next time step n+1 (time $t^{(n+1)}$) is determined, for example, as follows.

First, the volume of the compression chamber at time $t^{(n+1)}$ is determined by specifications of the rotors 20 and 21, and a relationship between a rotation angle that can be geometrically calculated and the volume of the compression chamber is obtained in advance, and the relationship is incorporated into the computation device 13 in the form of a lookup table, whereby the volume of the compression chamber that corresponds to the rotation angle (crank angle) θ at time $t^{(n+1)}$ ($=2\pi Nt^{(n+1)}$) can be obtained. At this time, information on the rotation speed N is used.

In addition, a minute gap actually exists between the male rotor 20, the female rotor 21, and the casing 22 that partition the compression chamber 23, and serves as a leakage flow path of the air and the lubricating oil. Although a cross-sectional shape of the leakage flow path of the gap changes depending on the rotation angle, a cross-sectional area of each leakage flow path at the next calculation step time $t^{(n+1)}$ can be obtained by obtaining in advance estimated values of the amount of gap based on geometric calculation based on the specifications of the rotors 20 and 21, the casing 22, and the like, a performance test performed in advance, and the like, and determining a relationship between the rotation angle and the cross-sectional area of the leakage flow path in the form of a lookup table by combining the estimated values (step S24).

In addition, another compression chamber adjacent to the calculation target compression chamber 23 is a compression chamber that is ahead of (starts to perform compression first) or behind (starts to perform compression later) the calculation target compression chamber 23 by a certain rotation angle α. Therefore, in a case where iterative calculation in the suction, compression, and discharge process sufficiently converges, the pressure and temperature of the adjacent compression chamber can be approximately obtained by referring to a value obtained by shifting $P^{(n)}$ and $T^{(n)}$ of the calculation target compression chamber 23 to the past by an amount corresponding to a difference of the rotation angle α. In a case where the adjacent compression chamber is ahead of the calculation target compression chamber, it is sufficient if the corresponding value of the rotation angle in the previous cycle is referred to with a process from suction to discharge as one cycle. When the pressure and temperature of the adjacent compression chambers and the cross-sectional area of the leakage flow path are obtained, a leakage flow rate can be obtained by a theoretical formula such as an experimental formula or a nozzle formula.

In addition, in a case where the oil is supplied to the compression chamber 23 in the calculation target time step, the flow rate is determined by pressures of portions in front of and behind the oil supply hole 24 and the shape of the oil supply hole 24. Therefore, for example, the oil supply amount can be obtained experimentally when the discharge pressure that is a high pressure supply source is changed, or the flow rate can be obtained analytically (alternatively, by a theoretical formula of orifice flow or the like) from the shape of the oil supply path and the discharge pressure (step S25).

Furthermore, the masses and energies of the air and the lubricating oil flowing into and out of the compression chamber 23 between times $t_{(n)}$ and $t^{(n+1)}$ can also be calculated by multiplying the obtained leakage flow rate and oil supply amount by a time interval $\Delta t=t^{(n+1)}-t^{(n)}$.

The lubricating oil supplied to compression chamber 23 exchanges heat with the air having a higher temperature. The amount of heat transfer can be calculated by experimentally obtaining the amount of heat transfer in advance as a function of the rotation speed, the suction temperature, and the oil supply amount or analyzing a gas-liquid two-phase flow in advance. Energy exchange (heat transfer amount) between the air in the compression chamber 23 and the lubricating oil can be calculated based on the obtained amount of heat transfer (step S26).

A density and internal energy of each of the air and the lubricating oil in the compression chamber 23 can be calculated by combining the amount of heat transfer and the energy exchange (step S27). Once the density and the internal energy are determined, the thermodynamic state is determined, and a pressure $P^{(n+1)}$ and a temperature $T^{(n+1)}$ at the next time step n+1 can be obtained by a state equation based on physical properties or information that is derived from the state equation and enables calculation of the pressure and the temperature as a function of the density and the internal energy (lookup table) (step S28).

By repeating the above calculation, the thermodynamic state of the compression chamber 23 can be sequentially calculated (step S2). Once the rotor rotation angle θ reaches a discharge start angle of the compression chamber 23 (step S3), a discharge temperature of the air can be obtained by obtaining the discharge flow rate from the compression chamber 23 based on the discharge pressure Pd, the pressure $P^{(n)}$ of the compression chamber 23, and given shape data of a discharge flow path by using a relational expression (or look-up table) between a pressure difference and the flow rate determined in advance by experiment or theory and incorporated in the computation device 13 (step S4), or by assuming that the air adiabatically expands from the pressure $P^{(n)}$ to the discharge pressure Pd. Thereafter, heat is exchanged between the air and the lubricating oil until the air and the lubricating oil are separated from each other in the separator tank 5. Similarly to the heat exchange in the compression chamber 23, the amount of heat transfer can also be obtained by a method such as creating a lookup table based on a result obtained in advance by an experiment, fluid analysis, or the like.

As described above, the lubricating oil 6 is cooled by the oil cooler 7 downstream of the separator tank 5, and is further supplied to the oil supply hole 24 through the pipe or the like. In a case where a driving force of the lubricating oil 6 is the pressure difference, as described above, the relationship between the pressure difference and the flow rate in the oil circulation path can be experimentally or analytically obtained, and a temperature change and a pressure change of the lubricating oil 6 can be predicted (estimated) by further considering a cooling capacity of the oil cooler 7. In addition, by performing fluid analysis or the like in consideration of the shape of the flow path through which the lubricating oil flows in advance, it is possible to estimate how long the lubricating oil stays at each portion of the flow path. By inputting the result to the computation device 13, it is possible to obtain a time history of the temperature change and the pressure change in the circulation path (a flow path from discharge from the compression chamber 23 to supply of the oil to the compression chamber 23 again via the separator tank 5, the oil cooler 7, and the like) of the lubricating oil. This corresponds to step S5 "calculate oil temperature/pressure change in oil circulation path" in FIG. 3.

As described above, a time cycle of the temperature and pressure of the lubricating oil circulating in the compressor can be estimated from the values detected by the suction temperature sensor 14, the discharge pressure sensor 15, and the rotation speed sensor 16.

In the above description, the discharge pressure and the motor rotation speed are directly detected using the discharge pressure sensor 15 and the rotation speed sensor 16. Instead, power (input power) of the motor can be detected using a power sensor that detects input power of the motor, for example, a power meter or an ammeter, so that the discharge pressure or the motor rotation speed can be detected without using either the discharge pressure sensor 15 or the rotation speed sensor 16.

That is, if the efficiency of the compressor and the volumetric efficiency are assumed in advance, theoretical compression power can be obtained from axial power of the motor, and the theoretical adiabatic compression power is given as a function of the suction pressure, the suction temperature, the discharge pressure, and the rotation speed if physical properties of the working fluid are determined. Therefore, instead of using either the discharge pressure sensor 15 or the rotation speed sensor 16, means for detecting the power or a current value of the motor may be used.

Next, a method of obtaining the degree of deterioration and the remaining life of the oil from the obtained estimated temperature and pressure cycle of the lubricating oil will be described. For example, as the total acid value is considered as a deterioration index of the oil, it is possible to obtain a relationship of how fast the total acid value increases when the target lubricating oil is exposed to a certain pressure or temperature by performing a material test of the lubricating oil in an environment in which the temperature or pressure is controlled in advance. By incorporating these databases (approximate expressions) in the computation device 13, it is possible to estimate the increase in total acid value by using the temperature and pressure cycle of the lubricating oil described above as an input condition. That is, the degree of deterioration of the lubricating oil can be estimated. This corresponds to step S6 of FIG. 3 "predict increase in total acid value from time series of oil temperatures/pressures".

FIG. 4 is a graph illustrating an example of the acquired data of the operation state, and illustrates an example of the suction temperature, the discharge pressure, and the rotation speed acquired by the oil-supply-type screw compressor. In a case where operation history data varying as in the graph of FIG. 4 is obtained for a long time, the increase in total acid value is predicted using the history data at each time, and the increases in total acid value are integrated, whereby a change in degree of deterioration in a period in which the operation history data is acquired can be predicted.

As a time when the lubricating oil is replaced with a new one is input to the computation device 13 as information and all pieces of history data (data illustrated as an example in FIG. 4) of the suction temperature, the discharge pressure, and the rotation speed after the oil replacement are recorded, it is possible to estimate how much the deterioration has progressed (the increase in total acid value) from the state of the new lubricating oil. If a predetermined quality standard of the lubricating oil (for example, an allowable upper limit value of the total acid value) is given to the computation device 13 (lubricating oil state estimation unit) at the time of product design or the like, it is possible to estimate how much time it takes until the degree of deterioration of the lubricating oil reaches the upper limit based on the past progress rate of deterioration up to the present or up to a certain point of time, and the time can be used as the estimated remaining life of the lubricating oil.

In the above description, as the most preferable condition, all the pieces of history data of the suction temperature, the discharge pressure, and the rotation speed are recorded. However, as long as data at the latest time and a time interval from when data is obtained immediately before can be acquired, an increase in degree of deterioration in the time interval can be estimated by the above-described method. Therefore, it is not always necessary to hold all the pieces of history data such as the temperature and the pressure by sequentially performing integration calculation only on the degree of deterioration. In addition, even if some data in the middle is lost, the remaining life of the lubricating oil can be estimated without any problem by performing the same calculation without using the data.

Furthermore, as illustrated in FIG. 4, even in a case where not all the pieces of operation history data are acquired from the last lubricating oil replacement, but the operation history data is held only for a certain period (a period P2 in FIG. 4) shorter than the entire operation period, the degree of progress of deterioration of the oil in an elapsed period from the lubricating oil replacement can be estimated only from the obtained operation history data by acquiring the elapsed time (a period P1+P2 in FIG. 4) from the last lubricating oil replacement. Therefore, by assuming that the deterioration progresses at a similar speed even in a period in which the operation history data cannot be acquired (a period P1 in FIG. 4), the degree of progress of deterioration after the oil replacement can be predicted, and the remaining life of the lubricating oil can be estimated in the same manner as described above.

In this case, the longer the period in which the operation history data is held (the period P2 in FIG. 4), the higher the estimation accuracy. However, in consideration of the shortest time cycle of a change of an environmental in which the compressor is operated (for example, a production activity using compressed air), it is preferable to hold the operation history data for at least one day, or integrate an instantaneous value of the period as the degree of deterioration as described above. For example, in a case where the compressor is operated in the same pattern every day, the degree of deterioration of the oil is estimated based on the operation history data of one day, and the degree of deterioration is integrated for an operation period of the compressor, so that the degree of progress of deterioration of the oil up to the present can be predicted to estimate the remaining life of the lubricating oil. Similarly, in a case where the compressor is operated in the same pattern in a cycle such as one week or several months, the degree of progress of deterioration of the oil (the degree of progress such as the total acid value) may be obtained based on the operation history data of the operation pattern, and the degree of progress of deterioration may be integrated according to the operation period of the compressor to obtain the remaining life.

According to the embodiment described above, it is possible to estimate the operation state history of the compressor, that is, the remaining life of the lubricating oil of the compressor, which varies depending on the operation environment and the history, by using the existing suction temperature sensor, discharge pressure sensor, motor rotation speed sensor, and the like included in the gas compressor, and it is possible to obtain an effect of improving economic feasibility by optimizing the oil replacement time, and achieving energy saving by optimizing the oil supply amount. In the above description, the temperature change and the pressure change of the lubricating oil are estimated to estimate the deterioration state, but the deterioration state can also be estimated from the estimation of only the temperature change of the lubricating oil. In this case, accuracy in estimating the deterioration state of the oil is slightly lower than that in a case where the pressure change is also considered, but the deterioration state of the oil can be estimated more easily.

Second Embodiment

Figure 5:
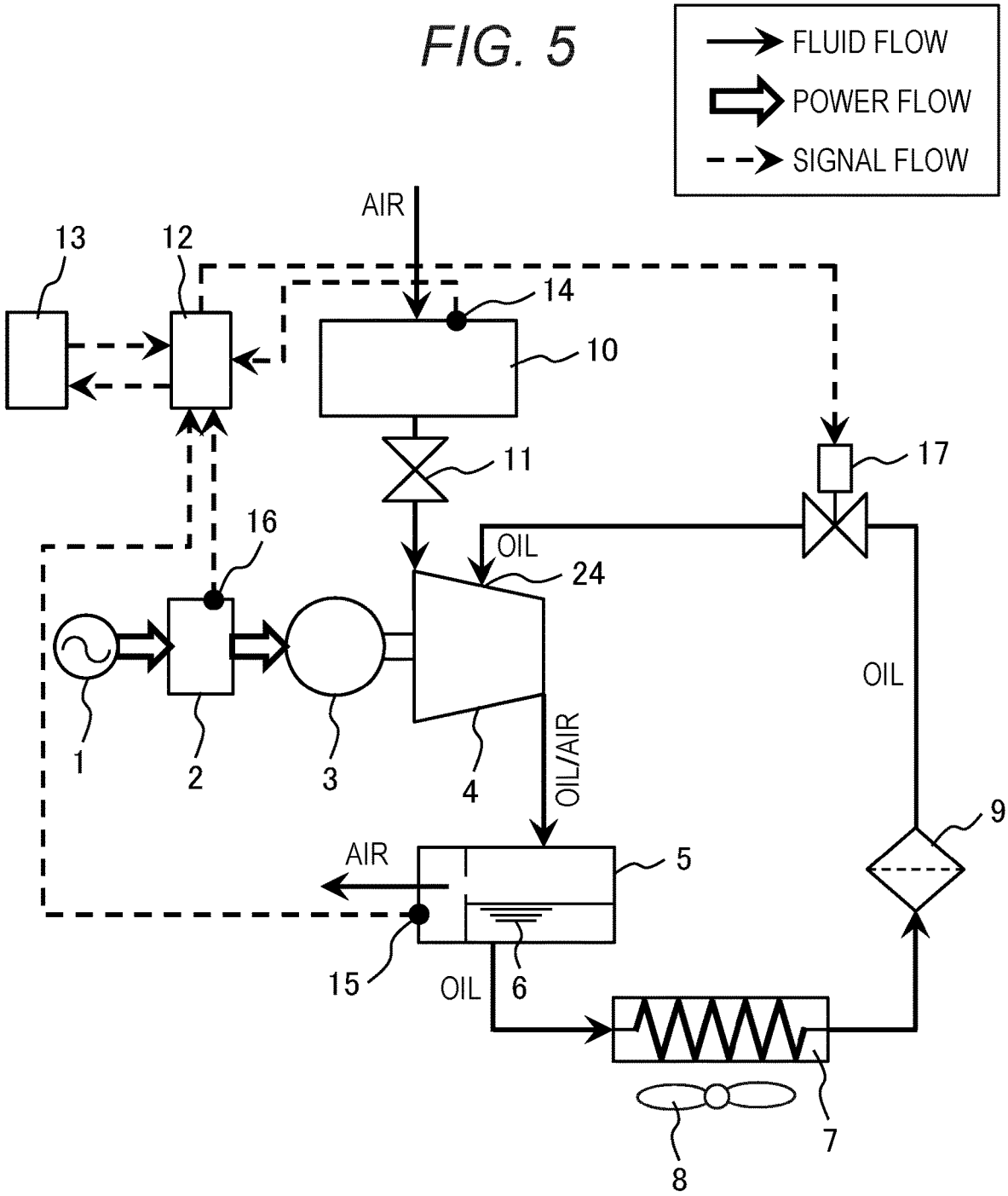
FIG. 5 is a system diagram illustrating a device configuration of a gas compressor according to a second embodiment of the present invention.

A second embodiment of the present invention will be described with reference to FIG. 5. FIG. 5 is a system diagram illustrating a device configuration of a screw compressor according to the second embodiment of the present invention. In the description of the second embodiment, a description of the same configuration as that of the first embodiment illustrated in FIG. 1 will be omitted, and different portions will be mainly described.

The present embodiment is different from the first embodiment in that a flow rate adjusting valve 17 is provided downstream of an oil filter 9 in a circulation path of a lubricating oil 6. An opening degree of the flow rate adjusting valve 17 can be freely changed by a transmission signal from a control device 12 by using a solenoid valve or the like. Therefore, in the second embodiment, a flow rate (oil supply amount) of the lubricating oil 6 supplied to a compression chamber 23 can be changed.

The lubricating oil 6 is stirred by rotors 20 and 21 in the compression chamber 23, and a power loss due to the stirring increases as the oil supply amount increases. Conversely, if the oil supply amount can be reduced, the stirring loss can be reduced, and efficiency of the compressor can be improved. However, when the oil supply amount is reduced, a smaller amount of oil is injected into compression chamber 23, and it is necessary to cool high-temperature air with a smaller amount of oil. For this reason, there is a problem that the lubricating oil becomes high in temperature and deterioration easily progresses.

To solve this problem, in the second embodiment, as described in the first embodiment, the remaining life of the lubricating oil 6 is estimated, and when an average load of the compressor is low to some extent and the remaining life is longer than a standard replacement time, the opening degree of the flow rate adjusting valve 17 is decreased according to a command value from the control device 12, and the amount of the oil supplied to the compression chamber 23 is reduced. At this time, if a relationship between the opening degree of the flow rate adjusting valve 17 or a pressure condition and the oil supply amount is acquired in advance by experiments or the like, the remaining life of the oil when the oil supply amount is reduced can be estimated by a method similar to the method described in the first embodiment.

Therefore, according to the present embodiment, it is possible to estimate a change in remaining life of the lubricating oil due to the reduction of the oil supply amount, and in a case where a load factor of the compressor is small and the remaining life is considerably long, it is possible to reduce the oil supply amount while reducing the remaining life to an allowable extent. As a result, it is possible to improve an operation efficiency of the compressor while securing reliability of the compressor, and it is possible to reduce an electricity rate for the compressor operation by achieving energy saving.

Other configurations are similar to those of the first embodiment.

Third Embodiment

Figure 6:
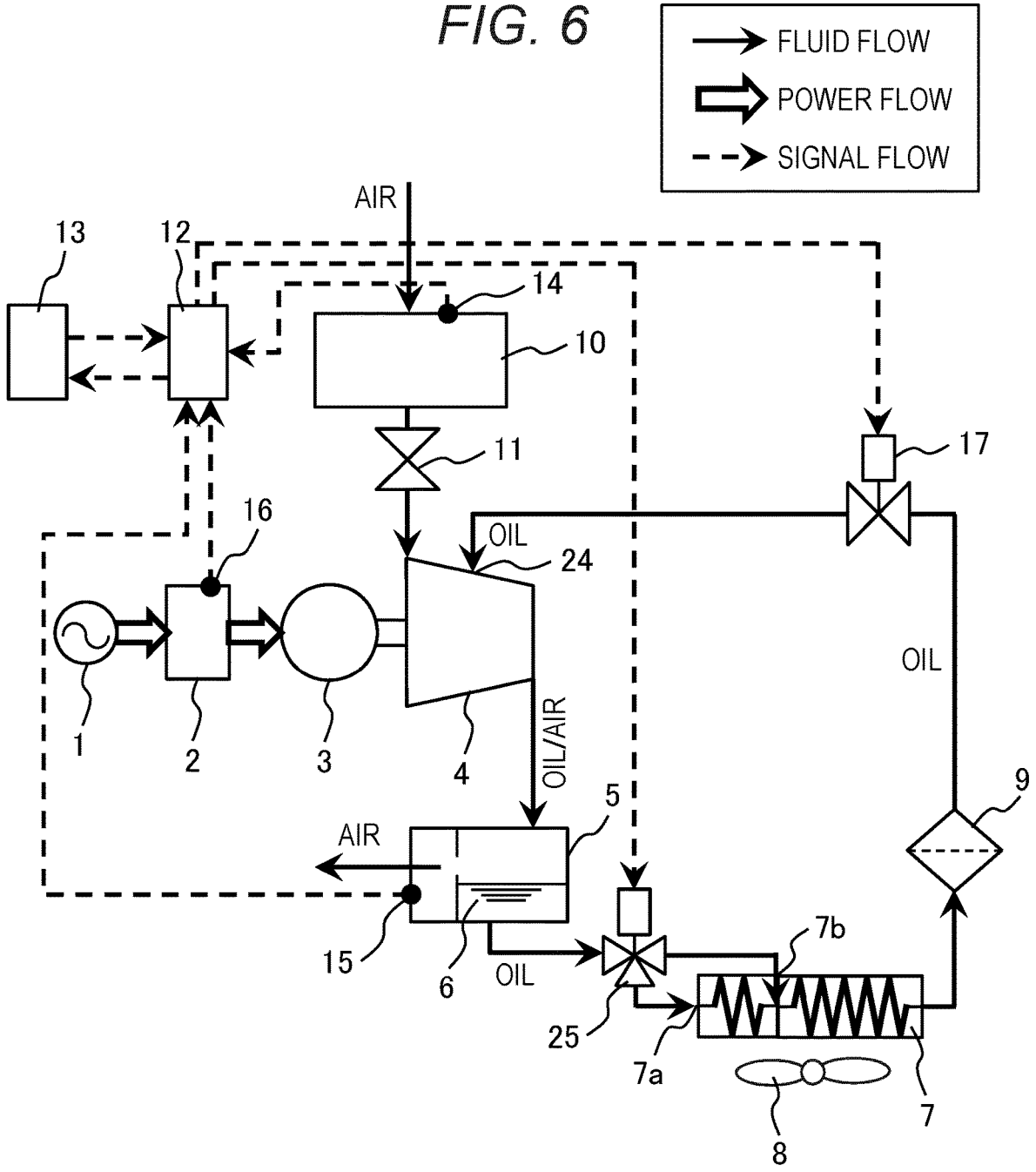
FIG. 6 is a system diagram illustrating a device configuration of a gas compressor according to a third embodiment of the present invention.

A third embodiment of the present invention will be described with reference to FIG. 6. FIG. 6 is a system diagram illustrating a device configuration of a screw compressor according to the third embodiment of the present invention. In the description of the third embodiment, a description of the same configurations as those of the first embodiment illustrated in FIG. 1 and the second embodiment illustrated in FIG. 5 will be omitted, and different portions will be mainly described.

In the third embodiment, similarly to the second embodiment, a flow rate adjusting valve 17 is provided downstream of an oil filter 9 in a circulation path of a lubricating oil 6.

In the present embodiment, a cooling capacity of an oil cooler 7 varies in accordance with an oil supply amount determined by an opening degree of the flow rate adjusting valve 17. In the present embodiment, a flow path switching valve 25 is provided upstream of the oil cooler 7 to select any one of a flow path in which the lubricating oil 6 from a separator tank 5 flows from an inlet end 7*a* of a heat exchange unit of the oil cooler 7 and a flow path in which the lubricating oil 6 flows from a middle portion 7*b* of the heat exchange unit of the oil cooler 7 that is positioned more downstream. The flow path switching valve 25 that switches the flow path is controlled by a control device 12.

It is assumed that the flow path switching valve 25 is in a state where the lubricating oil 6 flows from the middle portion 7*b* of the heat exchange unit of the oil cooler 7 at a certain point of time. At this time, as described in the second embodiment, in a case where an average load factor of the compressor is small and the remaining life of the oil is much longer than an allowable lower limit value, a stirring loss in a compression chamber 23 (see FIG. 2) can be reduced by reducing the oil supply amount by the flow rate adjusting valve 17.

However, when the oil supply amount is reduced, the flow rate of the lubricating oil 6 passing through the oil cooler 7 is reduced, and a cooling capacity of the oil cooler 7 is reduced. In order to cool compressed air to the same degree while reducing the oil supply amount, it is necessary to lower the temperature of the lubricating oil supplied from an oil supply hole 24 to the compression chamber 23 than before the reduction of the oil supply amount. However, since the cooling capacity of the oil cooler 7 is reduced, the lubricating oil cannot be cooled to a necessary and sufficient temperature, and the capacity to cool the compressed air in the compression chamber is reduced compared to before the oil supply amount is reduced. Therefore, air having a higher temperature is compressed, and extra power is thus required, so that there is a problem that the efficiency of the compressor is reduced.

On the other hand, in the third embodiment, the flow path switching valve 25 is switched at the same time as the oil supply amount is reduced, so that the lubricating oil 6 is controlled to flow from the inlet end 7*a* of the oil cooler 7. As a result, a heat transfer area of the heat exchange unit of the oil cooler 7 increases, and it is possible to suppress a reduction in cooling capacity due to a reduction in oil supply amount. That is, since the compressed air can be cooled by the lubricating oil having a lower temperature, the efficiency of the compressor can be improved.

Although the remaining life of the lubricating oil 6 is changed due to the increase in cooling capacity, a temperature cycle of the lubricating oil 6 based on the cooling capacity of the oil cooler 7 is estimated in the present invention as described in the first embodiment. Therefore, the cooling capacity can be controlled after predicting the remaining life of the lubricating oil 6 in a case where the flow path of the oil cooler 7 is switched. Therefore, it is possible to improve energy saving performance while maintaining reliability of the compressor.

Further, means for changing the cooling capacity of the oil cooler 7 is not necessarily limited to the above-described means, and for example, a flow path on an outlet side of the oil cooler 7 may be branched to switch the heat transfer area. Alternatively, when the opening degree of the flow rate adjusting valve 17 is decreased, a rotation speed of a cooler fan 8 that sends cooling air to the oil cooler 7 may be increased to prevent a reduction in cooling capacity of the oil cooler 7. That is, if the cooling capacity of the oil cooler 7 is controlled to be increased in a case where the opening degree of the flow rate adjusting valve 17 is decreased, the same effect as that of the third embodiment described above can be obtained.

Fourth Embodiment

Figure 7:
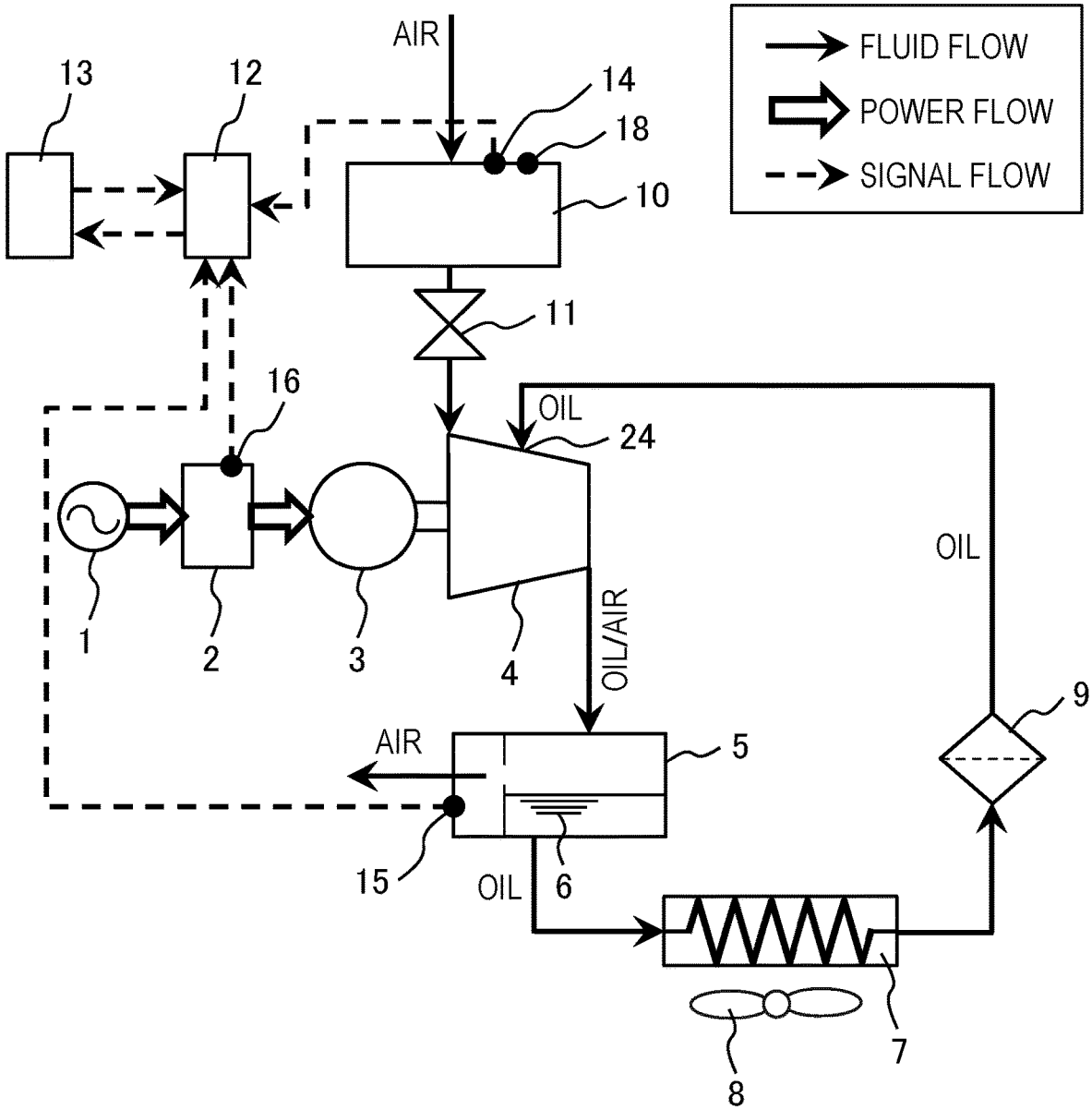
FIG. 7 is a system diagram illustrating a device configuration of a gas compressor according to a fourth embodiment of the present invention.
Figure 8:
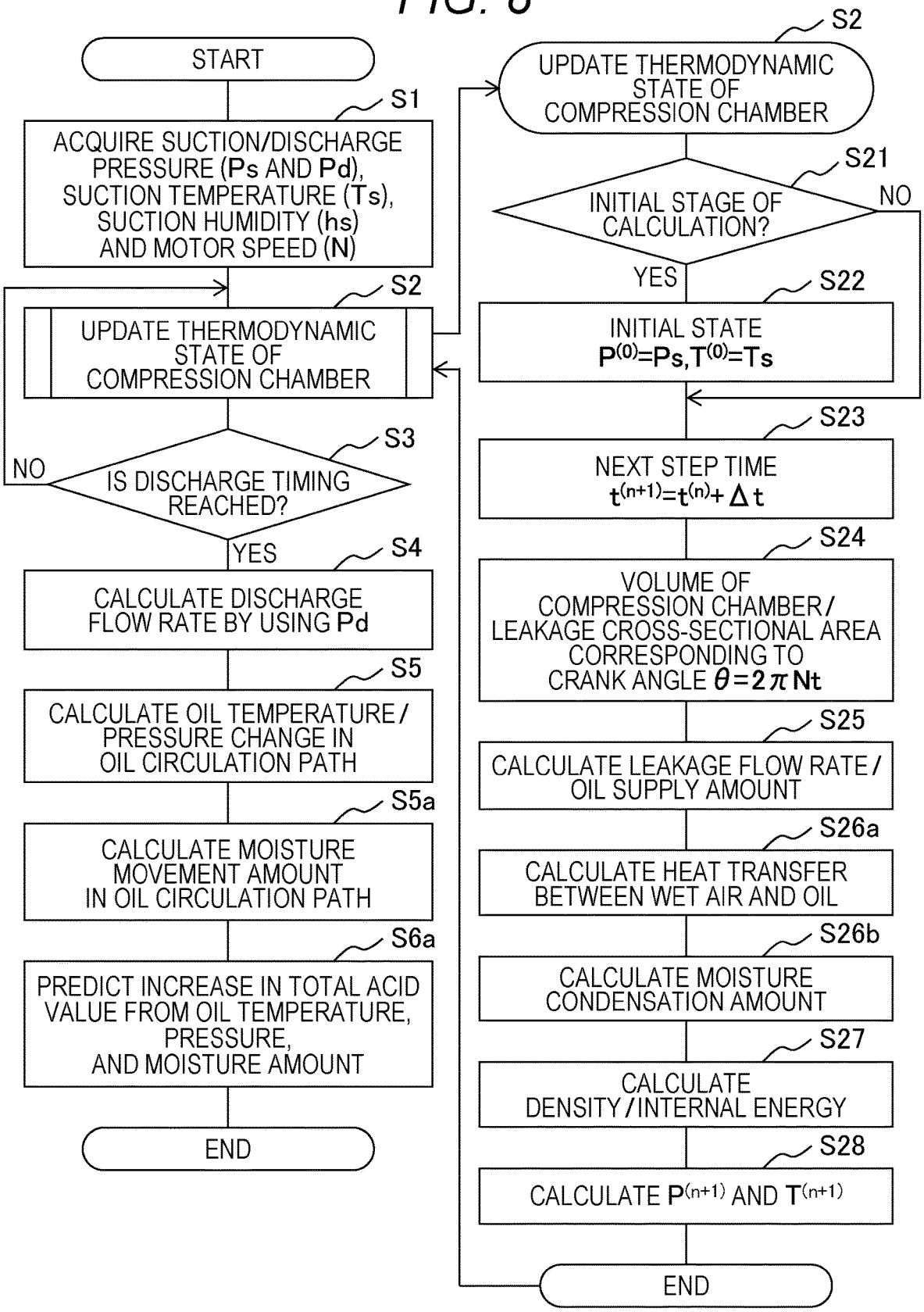
FIG. 8 is a flowchart illustrating an oil deterioration degree estimation procedure according to the fourth embodiment of the present invention.

A fourth embodiment of the present invention will be described with reference to FIGS. 7 and 8. FIG. 7 is a system diagram illustrating a device configuration of a screw compressor according to the fourth embodiment of the present invention, and FIG. 8 is a flowchart illustrating an oil deterioration degree estimation procedure according to the fourth embodiment. In the description of the fourth embodiment, a description of the same configuration as that of the first embodiment illustrated in FIGS. 1 to 4 will be omitted, and different portions will be mainly described.

In the fourth embodiment, as illustrated in FIG. 7, a humidity sensor 18 is provided in a suction side flow path upstream of a compression mechanism 4 in order to detect a humidity of air (working fluid) sucked into the compression mechanism 4 via a sucked air filter 10.

According to the fourth embodiment illustrated in FIG. 7, since the humidity of the air sucked into the compression mechanism 4 is detected, the amount of moisture contained in the sucked air can be estimated. Also in the fourth embodiment, as low-temperature lubricating oil is supplied to a compression chamber 23 in a procedure that is substantially the same as the flow of the first embodiment described with reference to FIG. 3, it is possible to calculate an amount of condensation of a part of moisture contained in the air when the compressed air is cooled.

Specifically, for example, a relationship between the amount of condensed moisture that is generated and an operation condition may be acquired by an experiment of compressing air with a humidity changed in advance, and may be incorporated into the computation device 13 as a lookup table. Alternatively, a speed at which condensation occurs may be calculated by using a correlation formula of a known material transfer rate may be used by assuming a flow field in which the lubricating oil scatters in the compression chamber 23, or by using a relationship in which a condensation amount per unit time is proportional to the product of a concentration difference of the moisture in the air and a material transfer rate obtained by fluid analysis as a mass transfer theory.

The procedure corresponds to a portion indicated as step S26*a* of "calculate heat transfer between wet air and oil" and step S26*b* of "calculate moisture condensation amount" in the flow on the right side in FIG. 8. In step S26*b* of "calculate moisture condensation amount", the above-described calculation is performed, and in step S26*a* of "calculate heat transfer between wet air and oil", the calculation including an effect of latent heat caused by moisture condensation can be performed in the same manner as in the first embodiment.

In addition, moisture condensed or evaporated from air in a separator tank 5 and pipes in front of and behind the separator tank 5 can also be similarly evaporated or condensed at a speed associated with the operation condition in advance by an experimental method or a numerical analysis method (corresponding to step S5*a* of "calculate moisture movement amount in oil circulation path" in FIG. 8).

According to the fourth embodiment, not only a temperature and pressure cycle of the lubricating oil but also a change in amount of moisture mixed in the lubricating oil can be predicted by the above method. Furthermore, as described in the first embodiment, if the amount of change in degree of deterioration (for example, the total acid value) with respect to the temperature and pressure is acquired in advance by experiment or the like, and the amount of change in degree of deterioration due to the moisture amount is also acquired, the remaining life of the lubricating oil can be calculated with a higher accuracy. Therefore, an oil replacement time can be further optimized. In addition, as in the second embodiment described above, since it is possible to easily reduce the oil supply amount based on the remaining life of the lubricating oil by using the flow rate adjusting valve 17, it is also possible to further improve the efficiency of the compressor.

In the present embodiment, the humidity of the sucked air is detected as the humidity sensor 18 is provided, but the humidity of the sucked air may be estimated by acquiring information on an installation area of the compressor and using weather data separately provided from a related organization instead of providing the humidity sensor 18. In this case, there is a high possibility that accuracy in estimating the moisture amount in the air decreases as compared with a case of using the humidity sensor 18, but as described in the fourth embodiment, an effect of estimating the remaining life of the lubricating oil in consideration of the moisture amount can be obtained.

Note that the present invention is not limited to the embodiments described above, but includes various modified examples. Further, a part of a configuration of an embodiment can be replaced with a configuration of another embodiment, and a configuration of an embodiment can be added with a configuration of another embodiment.

In addition, the above-described embodiments have been described in detail in order to explain the present invention in an easy-to-understand manner, and the present invention is not necessarily limited to those having all the configurations described.

What is claimed is:

1. A gas compressor including a compression mechanism that compresses a sucked working fluid, a separator tank that introduces lubricating oil to be supplied to the compression mechanism and a mixed fluid of the working fluid and the lubricating oil discharged from the compression mechanism and separates the lubricating oil from the compressed working fluid, an oil cooler that introduces and cools the lubricating oil separated in the separator tank, an oil circulation path that supplies the lubricating oil cooled by the oil cooler to the compression mechanism, and a motor that drives the compression mechanism and is isolated from the oil circulation path, the gas compressor comprising:

a suction temperature sensor that detects a suction temperature of the working fluid sucked into the compression mechanism;

a discharge pressure sensor that detects a discharge pressure of the working fluid compressed by the compression mechanism;

a rotation speed sensor that detects a rotation speed of the motor; and a lubricating oil state estimation unit that estimates a temperature of the lubricating oil based on the detected suction temperature, discharge pressure, and rotation speed of the motor, wherein the lubricating oil state estimation unit estimates a deterioration state of the lubricating oil based on the estimated temperature of the lubricating oil.

2. The gas compressor according to claim 1, wherein the lubricating oil state estimation unit estimates a pressure of the lubricating oil together with the temperature of the lubricating oil, and estimates the deterioration state of the lubricating oil based on the temperature and the pressure of the lubricating oil.

3. The gas compressor according to claim 1, wherein the lubricating oil state estimation unit acquires values of the suction temperature, the discharge pressure, and the rotation speed of the motor in a certain period shorter than an entire operation period, and an elapsed time from last lubricating oil replacement, and estimates the deterioration state of the lubricating oil based on the values and the elapsed time.

4. The gas compressor according to claim 3, wherein the lubricating oil state estimation unit estimates the deterioration state of the lubricating oil based on the values of the suction temperature, the discharge pressure, and the rotation speed of the motor acquired in a period of at least one day.

5. The gas compressor according to claim 3, wherein the certain period is a shortest time cycle of a change of an environment in which the compressor is operated, the deterioration state of the lubricating oil in the certain period is estimated based on the values of the suction temperature, the discharge pressure, and the rotation speed of the motor acquired in the shortest time cycle, and the deterioration state is integrated for the operation period of the compressor to predict a degree of progress of deterioration of the oil and estimate a remaining life of the lubricating oil.

6. The gas compressor according to claim 3, wherein an allowable upper limit value of a total acid value of the lubricating oil is given to the lubricating oil state estimation unit, and a remaining life of the lubricating oil is estimated based on the allowable upper limit value of the total acid value and the estimated deterioration state of the lubricating oil.

7. The gas compressor according to claim 1, further comprising a flow rate adjusting valve provided in the oil circulation path that supplies the lubricating oil to the compression mechanism, wherein the flow rate adjusting valve is controlled based on the deterioration state of the lubricating oil estimated by the lubricating oil state estimation unit to adjust a flow rate of the lubricating oil supplied to the compression mechanism.

8. The gas compressor according to claim 7, wherein the oil cooler includes a cooler fan that generates cooling air for cooling the lubricating oil, and a rotation speed of the cooler fan is increased when an opening degree of the flow rate adjusting valve is decreased.

9. The gas compressor according to claim 7, wherein the oil cooler includes a flow path switching valve for switching a heat transfer area of a heat exchange unit through which the lubricating oil flows, and the flow path switching valve is controlled to increase the heat transfer area of the heat exchange unit of the oil cooler when an opening degree of the flow rate adjusting valve is decreased.

10. The gas compressor according to claim 1, wherein the lubricating oil state estimation unit estimates an amount of moisture mixed in and accumulated in the lubricating oil based on a suction humidity of the working fluid sucked into the compression mechanism, the moisture being a part of moisture contained in the working fluid, and estimates the deterioration state of the lubricating oil based on the estimated temperature of the lubricating oil and the estimated amount of moisture contained in the lubricating oil.

11. The gas compressor according to claim 10, further comprising a humidity sensor that detects the suction humidity of the working fluid sucked into the compression mechanism, wherein the lubricating oil state estimation unit estimates the amount of moisture contained in the lubricating oil based on the humidity detected by the humidity sensor.

12. A gas compressor including a compression mechanism that compresses a sucked working fluid, a separator tank that introduces lubricating oil to be supplied to the compression mechanism and a mixed fluid of the working fluid and the lubricating oil discharged from the compression mechanism and separates the lubricating oil from the compressed working fluid, an oil cooler that introduces and cools the lubricating oil separated in the separator tank, an oil circulation path that supplies the lubricating oil cooled by the oil cooler to the compression mechanism, and a motor that drives the compression mechanism and is isolated from the oil circulation path, the gas compressor comprising:

a suction temperature sensor that detects a suction temperature of the working fluid sucked into the compression mechanism;

at least one of a discharge pressure sensor that detects a discharge pressure of the working fluid compressed by the compression mechanism or a rotation speed sensor that detects a rotation speed of the motor, the discharge pressure or the rotation speed of the motor being detected by the comprised discharge pressure sensor or rotation speed sensor;

a power sensor that detects input power of the motor; and a lubricating oil state estimation unit that calculates the rotation speed or the discharge pressure that is not detected by using values of the input power detected by the power sensor and the discharge pressure or rotation speed detected by the comprised discharge pressure sensor or rotation speed sensor, and estimates a temperature of the lubricating oil based on the detected suction temperature, the detected discharge pressure or rotation speed of the motor, and the calculated rotation speed of the motor or discharge pressure, wherein the lubricating oil state estimation unit estimates a deterioration state of the lubricating oil based on the estimated temperature of the lubricating oil.

13. The gas compressor according to claim 12, wherein the lubricating oil state estimation unit estimates a pressure of the lubricating oil together with the temperature of the lubricating oil, and estimates the deterioration state of the lubricating oil based on the temperature and the pressure of the lubricating oil.

14. The gas compressor according to claim 12, wherein the lubricating oil state estimation unit acquires values of the suction temperature, the discharge pressure, and the rotation speed of the motor in a certain period shorter than an entire operation period, and an elapsed time from last lubricating oil replacement, and estimates the deterioration state of the lubricating oil based on the values and the elapsed time.

15. The gas compressor according to claim 14, wherein the lubricating oil state estimation unit estimates the deterioration state of the lubricating oil based on the values of the suction temperature, the discharge pressure, and the rotation speed of the motor acquired in a period of at least one day.

16. The gas compressor according to claim 14, wherein the certain period is a shortest time cycle of a change of an environment in which the compressor is operated, the deterioration state of the lubricating oil in the certain period is estimated based on the values of the suction temperature, the discharge pressure, and the rotation speed of the motor acquired in the shortest time cycle, and the deterioration state is integrated for the operation period of the compressor to predict a degree of progress of deterioration of the oil and estimate a remaining life of the lubricating oil.

17. The gas compressor according to claim 14, wherein an allowable upper limit value of a total acid value of the lubricating oil is given to the lubricating oil state estimation unit, and a remaining life of the lubricating oil is estimated based on the allowable upper limit value of the total acid value and the estimated deterioration state of the lubricating oil.

18. The gas compressor according to claim 12, further comprising a flow rate adjusting valve provided in the oil circulation path that supplies the lubricating oil to the compression mechanism, wherein the flow rate adjusting valve is controlled based on the deterioration state of the lubricating oil estimated by the lubricating oil state estimation unit to adjust a flow rate of the lubricating oil supplied to the compression mechanism.

19. The gas compressor according to claim 18, wherein the oil cooler includes a cooler fan that generates cooling air for cooling the lubricating oil, and a rotation speed of the cooler fan is increased when an opening degree of the flow rate adjusting valve is decreased.

20. The gas compressor according to claim 18, wherein the oil cooler includes a flow path switching valve for switching a heat transfer area of a heat exchange unit through which the lubricating oil flows, and the flow path switching valve is controlled to increase the heat transfer area of the heat exchange unit of the oil cooler when an opening degree of the flow rate adjusting valve is decreased.

21. The gas compressor according to claim 12, wherein the lubricating oil state estimation unit estimates an amount of moisture mixed in and accumulated in the lubricating oil based on a suction humidity of the working fluid sucked into the compression mechanism, the moisture being a part of moisture contained in the working fluid, and estimates the deterioration state of the lubricating oil based on the estimated temperature of the lubricating oil and the estimated amount of moisture contained in the lubricating oil.

22. The gas compressor according to claim 21, further comprising a humidity sensor that detects the suction humidity of the working fluid sucked into the compression mechanism, wherein the lubricating oil state estimation unit estimates the amount of moisture contained in the lubricating oil based on the humidity detected by the humidity sensor.

* * * * *